United States Patent [19]

Klaus

[11] Patent Number: 4,754,383

[45] Date of Patent: Jun. 28, 1988

[54] SUPPORT FOR ELECTRIC LAMP AND ENCLOSURE FOR SAID LAMP

[75] Inventor: Dale A. Klaus, St. Louis County, Mo.

[73] Assignee: Dal Partnership, St. Louis, Mo.

[21] Appl. No.: 30,969

[22] Filed: Mar. 27, 1987

[51] Int. Cl.[4] ..... F21S 1/10

[52] U.S. Cl. ..... 362/363; 362/353; 362/374; 248/343; 403/349

[58] Field of Search ..... 362/311, 363, 368, 453, 362/455, 374, 378; 248/342, 343, 344, 222.3; 403/349

[56] References Cited

U.S. PATENT DOCUMENTS

| | | | |
|---|---|---|---|
| 3,191,021 | 6/1965 | Berry et al. | 362/363 |
| 3,524,981 | 8/1970 | Auerbach | 362/433 |
| 3,930,631 | 1/1976 | Laarm | 248/343 |
| 3,974,373 | 8/1976 | Zapolsky | 362/363 |
| 4,104,711 | 8/1978 | Carter | 362/363 |
| 4,175,282 | 11/1979 | Grindle et al. | 362/363 |
| 4,320,949 | 3/1982 | Pagano | 362/363 |

FOREIGN PATENT DOCUMENTS

| | | | |
|---|---|---|---|
| 418936 | 9/1925 | Fed. Rep. of Germany | 362/363 |

*Primary Examiner*—Charles J. Myhre
*Assistant Examiner*—David A. Okonsky
*Attorney, Agent, or Firm*—Rey Eilers

[57] ABSTRACT

The present invention provides a ceiling-mounted or wall-mounted light fixture, an enclosure which is releasably securable to that fixture, interacting supporting surfaces on that enclosure and on that fixture which permit rotation of that enclosure relative to that fixture to secure that enclosure to that fixture or to release that enclosure from that fixture, a mold-smooth fixture-receiving surface on that enclosure, and a die-cut enclosure-engaging surface on that fixture which will always provide a smooth engagement between itself and the mold-smooth fixture-receiving surface on that enclosure. Those interacting supporting surfaces enable rotation of that enclosure relative to that fixture to cause automatic movement of the mold-smooth fixture-receiving surface into engagement with the die-cut enclosure-engaging surface, or to cause automatic release of that enclosure from that fixture; and that mold-smooth fixture-receiving surface will be moved into engagement with the die-cut enclosure-engaging surface regardless of any manufacturing tolerances.

16 Claims, 1 Drawing Sheet

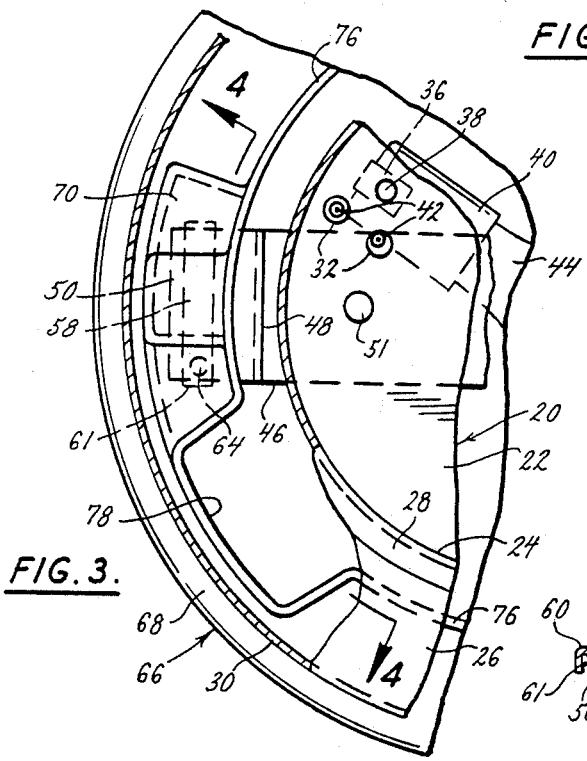
FIG. 1.
FIG. 3.
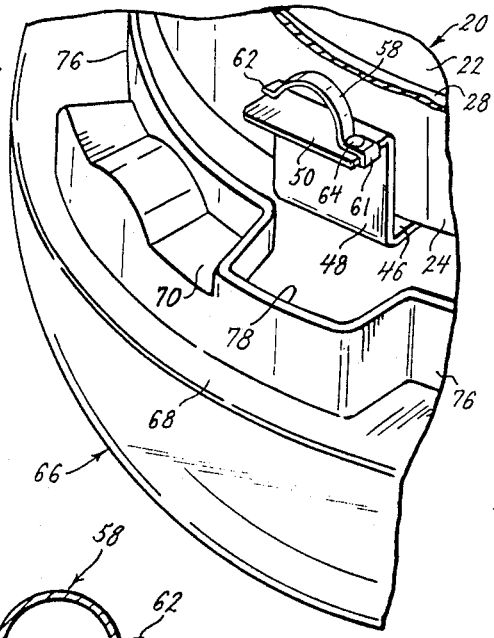
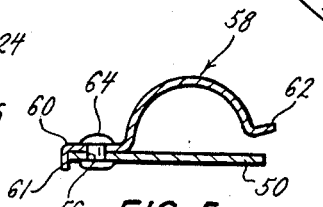
FIG. 5.
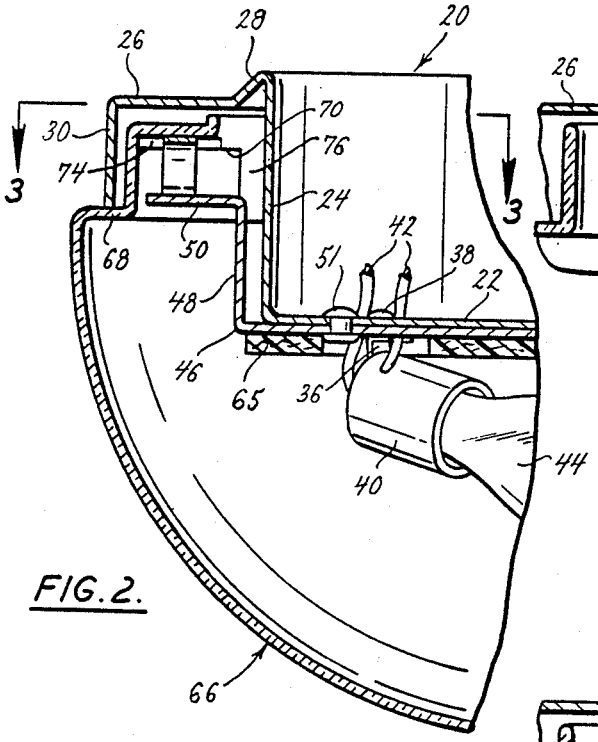
FIG. 2.
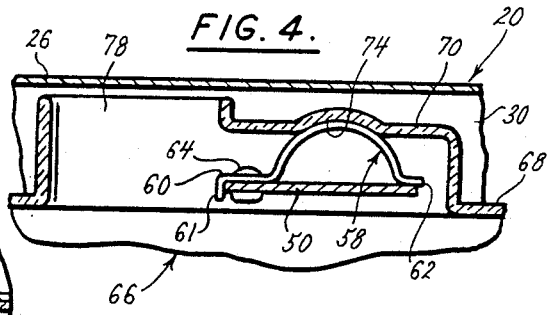
FIG. 4.
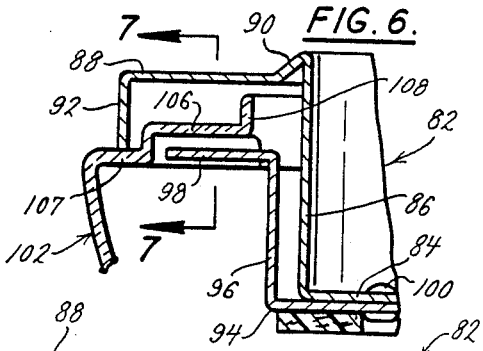
FIG. 6.
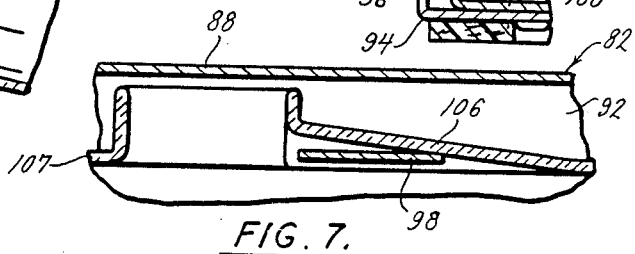
FIG. 7.

SUPPORT FOR ELECTRIC LAMP AND ENCLOSURE FOR SAID LAMP

BACKGROUND OF THE INVENTION

1. Field of the Invention

This invention relates to improvements in light fixtures which are securable to ceilings or walls, and to enclosures which are securable to those fixtures. More particularly, this invention relates to fixtures and to enclosures which are readily secured to, and readily separated from, those fixtures.

2. Description of the Prior Art

Light fixtures, that are securable to ceilings and to walls, frequently have a plurality of knurled screws that can be rotated into engagement with annular collars, on enclosures for those fixtures, to hold those enclosures in engagement with those fixtures. Whenever it is desirable to remove any of those enclosures, for replacement of the light source or for cleaning that enclosure or the light fixture, the knurled-head screws will be rotated away from the collar on that enclosure to free that enclosure for movement away from that light fixture. To make the screws relatively unobtrusive, the heads of those screws are frequently made quite small; and hence it can be difficult to grip those heads tightly enough to tighten or loosen those screws. Also, those screws can become so tightly engaged with the collar on an enclosure that it is difficult to rotate them away from that collar. As a result, the use of knurled-head screws which directly engage an enclosure for a light fixture to hold that enclosure in engagement with a fixture is objectionable.

Other light fixtures have pivoted fingers or tongues that are normally held in extended position by a helical extension spring. Those fingers or tongues can be moved inwardly to enable the collar of a glass enclosure to be telescoped up past those fingers or tongues; and, thereafter, the spring will move those fingers or tongues into position to underlie and to support the annular flange between that collar and the rest of that enclosure. Such fixtures are expensive, the fingers and tongues do not always pivot easily, and the springs have to be made so they are strong enough to prevent accidental release of the enclosures but are not so strong that they require users to exert heavy forces during the separation of the enclosures from those fixtures. As a result, those fixtures are not as desirable as a fixture should be.

Still other light fixtures are equipped with springs that have legs which extend through slots in brackets that are disposable within the glass enclosures that are used with those fixtures. Those springs respond to downward pulls on the enclosures to cause the slotted brackets to slip downwardly along the legs of the springs until those brackets are intercepted and held by the feet on those legs. The upper ends of the springs present inclined faces to the slotted brackets; and hence they can urge the enclosures up against the fixtures. Those fixtures are very expensive, they can create shadows on the glass enclosures, they force the user to separate the springs from the slotted brackets whenever the enclosures are to be separated from the fixtures for cleaning, they force the user to fit the springs into the slots in the brackets whenever the enclosures are to be connected to the fixtures, and they provide only limited amounts of space for a user's fingers. As a result, those fixtures are not as desirable as a fixture should be.

Other arrangements have been proposed for releasably holding enclosures in assembled relation with ceiling or wall mounted light fixtures, but none of those arrangements has been completely satisfactory. Moreover, many of those arrangements have never reached the market.

SUMMARY OF THE INVENTION

The present invention provides a ceiling-mounted or wall-mounted light fixture, an enclosure which is releasably securable to that fixture, a mold-smooth fixture-receiving surface on that enclosure, a die-cut enclosure-engaging surface on that fixture, and interacting supporting surfaces on that enclosure and on that fixture which permit rotation of that enclosure relative to that fixture to secure that enclosure to that fixture with that mold-smooth fixture-receiving surface in engagement with that die-cut enclosure-engaging surface, or to release that enclosure from that fixture. The mold-smooth fixture-receiving surface on that enclosure and the die-cut enclosure-engaging surface on that fixture will always provide a smooth engagement between that light fixture and that enclosure. It is, therefore, an object of the present invention to provide a light fixture which has a die-cut enclosure-engaging surface thereon, an enclosure which has a mold-smooth fixture-receiving surface thereon, and interacting supporting surfaces on that enclosure and on that fixture which permit rotation of that enclosure relative to that fixture to secure that enclosure to that fixture with that mold-smooth fixture-receiving surface in engagement with that die-cut enclosure-engaging surface, or to release that enclosure from that fixture.

The interacting supporting surfaces on the light fixture and on the enclosure enable rotation of that enclosure relative to that fixture to cause automatic movement of the mold-smooth fixture-receiving surface on that enclosure into engagement with the die-cut enclosure-engaging surface on that fixture or to cause automatic release of that enclosure from that fixture. Such an arrangement is better than the prior arrangements for interconnecting and releasing enclosures and the light fixtures with which they are used. It is, therefore, an object of the present invention to provide interacting supporting surfaces on a light fixture and on an enclosure which automatically respond to rotation of that enclosure relative to that fixture to cause automatic movement of the mold-smooth fixture-receiving surface into engagement with the die-cut enclosure-engaging surface, or to cause automatic release of that enclosure from that fixture.

In a preferred embodiment of the present invention, the interacting supporting surfaces on the light fixture include resilient members that yield during relative rotation of the fixture and of the enclosure therefor into and out of engagement with each other. Once that fixture and that enclosure have been rotated into engagement with each other, the resilient members will engage supporting surfaces on the enclosure to resist accidental rotation of that enclosure relative to that fixture. Those resilient members are desirable; because they provide a predetermined frictional force between the supporting surfaces on the enclosure and the fixture, rather than provide a frictional force that is controlled by the force which a person uses to rotate that enclosure into assembled relation with that fixture. It is, therefore, an object of the present invention to provide the interacting supporting surfaces on a light fixture with resilient members that engage supporting surfaces on the enclosure for that light fixture to provide a predetermined frictional force between that enclosure and that fixture.

In the preferred embodiment of the present invention, arcuate recesses are provided in the interacting supporting surfaces on the enclosure; and those arcuate recesses receive the upper portions of the resilient members on the interacting supporting surfaces of that light fixture. In doing so, those recesses and those resilient members provide a predetermined position for the enclosure relative to the fixture. It is, therefore, an object of the present invention to provide arcuate recesses in the interacting supporting surfaces of an enclosure which receive the upper portions of the resilient members on a light fixture to provide a predetermined position for that enclosure relative to that fixture.

In each of the preferred embodiments of the present invention, the mold-smooth fixture-receiving surface on the enclosure is moved into engagement with the die-cut enclosure-engaging surface on the fixture, regardless of any manufacturing tolerances in the thickness of the enclosure; and also regardless of any manufacturing tolerances in the height of the upstanding collar-like portion of the enclosure. As a result, ready relative rotation of the enclosure and of the fixture at all times is assured. It is, therefore, an object of the present invention to provide a light fixture and an enclosure therefor wherein the mold-smooth fixture-receiving surface on the enclosure is moved into engagement with the die-cut enclosure-engaging surface on the fixture regardless of manufacturing tolerances.

In at least one of the preferred embodiments of light fixture provided by the present invention, there is a broad bottom surface adjacent which one or more lamps are mounted; and the interacting supporting surfaces on that fixture are disposed above the level of that broad surface. This is desirable; because it keeps those interacting supporting surfaces from casting shadows on any normally-visible part of the enclosure for that fixture. It is, therefore, an object of the present invention to provide a light fixture with a bottom surface, and with interacting supporting surfaces disposed above the level of that broad surface to keep those interacting supporting surfaces from casting shadows on any normally-visible part of the enclosure for that fixture.

Other and further objects and advantages of the present invention should become apparent from an examination of the drawing and accompanying description.

In the drawing and accompanying description, two preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

FIG. 1 is an exploded perspective view of part of a light fixture and of part of an enclosure for that fixture which are made in accordance with the principles and teachings of the present invention;

FIG. 2 is a vertical section through parts of the enclosure and fixture of FIG. 1 when that enclosure and fixture are assembled;

FIG. 3 is a section that is taken along a plane which is denoted by the line 3—3 in FIG. 2;

FIG. 4 is a section that is taken along a curved line 4—4 in FIG. 3;

FIG. 5 is a sectional view through part of the structure shown in FIG. 4;

FIG. 6 is a vertical section through parts of alternate embodiments of light fixture and enclosure therefor which are made in accordance with the priciples and teachings of the present invention; and FIG. 7 is a section that is taken along a plane denoted by the line 7—7 in FIG. 6.

DESCRIPTION OF THE PREFERRED EMBODIMENTS

Referring particularly to FIGS. 1–5, the numeral 20 generally denotes a ceiling canopy or mounting pan which can be secured to a ceiling or to a wall by bolts, screws or the like. That pan has a broad, essentially-planar bottom 22 and an upstanding annular wall 24. A horizontal annular flange 26 extends outwardly from the upper edge of the annular wall 24; and an annular rib 28 is formed in that flange. That annular rib is of generally triangular cross section, as shown by FIG. 2. An annular skirt 30 extends downwardly from the periphery of the annular flange 26. The lower edge of that annular skirt is formed by a die during the making of the pan 20; and hence that edge is disposed a known and fixed distance below the annular flange 26. In normal usage, the annular rib 28 will engage a ceiling or a wall; and that rib will be held stationary against that ceiling or wall by the bolts, screws or the like, not shown, which are used to hold the pan 20.

Holes 32 are provided in the bottom 22 to accommodate flexible conductors 42 from a lamp socket 40 that is secured to that bottom by a rivet 38 and an L-shaped bracket 36. That socket is intended to, and can, hold an electric lamp 44. Holes 34 are provided in the bottom 22 to accommodate the bolts, screws or the like, not shown, which are used to hold the pan 20 against a ceiling or wall.

An elongated strap 46 is secured to the lower face of the bottom 22 of the pan 20 by rivets 51; and that strap has upwardly bent arms 48 which are equipped with outwardly-extending flanges or ears 50. The strap 46 will essentially function as an integral part of the pan 20. An opening 56 is provided in each flange 50; and those openings are adjacent the outer edges of those flanges, and also are adjacent the right-hand edges of those flanges, as the strap 46 is viewed in FIG. 1.

The numeral 58 denotes an arcuate spring which has feet 60 and 62 projecting laterally outwardly from the ends thereof. The foot 60 has a downwardly-bent end 61 which will abut the right-hand edge of one of the flanges 50, as shown by FIG. 1. That spring has an opening in the foot 60; and the numeral 64 denotes a rivet which fills the opening 56 and the opening in that foot to help the bent end 61 fixedly secure that foot to the flange 50. The foot 62 on the spring 58 is disposed adjacent to, but can move vertically relative to, that flange as that spring is flexed. Ordinarily, the foot 62 is spaced above the upper surface of the flange 50, as shown by FIG. 5.

A thin insulator 65 underlies the central part of strap 46 and the lower face of the bottom 22. The lower face of that insulator is coated with a highly-reflective metal foil or other material. As a result, light from the lamp 44, which is held by the lamp socket 40, will be directed away from the pan 20. Such an insulator is not an essential part of the present invention.

The numeral 66 generally denotes an enclosure for the lamp 44; and that enclosure will preferably be made from a translucent material. That enclosure has a cylindrical collar-like wall 76 which is dimensioned to surround the annular wall 24 of the pan 20; and that wall extends upwardly from the inner periphery of a horizontally-directed annular flange 68 adjacent the top of enclosure 66. Notches 78 are provided in the wall 76 and also in the flange 68. Those notches are dimensioned to accomodate the flanges or ears 50 on the strap 46 whenever the enclosure 66 is to be moved into, or out of, engagement with the pan 20. Step-like surfaces 70 are provided as part of the annular flange 68; and those step-like surfaces are adjacent the notches 78. Arcuate recesses 74 are formed in the lower faces of the step-like surfaces 70; and those recesses have curvatures that are complementary to the upper portions of the springs 58, as shown by FIG. 4.

The pan 20 will be suitably secured to a ceiling or wall after the power-supply and grounding conductors in that ceiling or wall have been connected to the flexible conductors 42. Those connections, and that securement, will be done in the manner customarily used in the electrical trade.

Whenever it is desirable to assemble the enclosure 66 with the pan 20, that enclosure will be positioned so the notches 78 thereof are in register with the flanges or ears 50 on the strap 46. That enclosure will then be moved toward the pan 20 until the wall 76 surrounds the wall 24 of that pan and the leading edges of the step-like surfaces 70 are disposed above the level of the flanges 50 on the strap 46. At this time, the lower edge of the wall 30 will be very close to, or even in engagement with, the annular flange 68 on the enclosure 66. That enclosure will then be rotated in the clockwise direction as it is viewed from below; and that rotation will cause the leading edges of the step-like surfaces 70 to move into position above the upper surfaces of the flanges 50. That rotation will be continued until the arcuate recesses 74, in the under faces of the step-like surfaces 70, have moved over, and into engagement with, the uppermost portions of the springs 58. As the step-like surfaces 70 move relative to the upper surfaces of the springs 58, those springs will be bowed downwardly because of the engagement between the lower edge of the annular skirt or wall 30 on the pan 20 and the upper face of the annular flange 68 on the enclosure 66. When the uppermost portions of the springs 58 move into register with the recesses 74, those springs will respond to the restorative forces therein to move upwardly into engagement with those recesses. Those engagements will appreciably resist further rotation of the enclosure 66 in the clockwise direction, and will thereby indicate to the person holding the enclosure that the enclosure has attained the proper position relative to the pan 20. Thereafter, the resilient engagements between the springs 58 and the recesses 74 will provide forces which will coact with the frictional force between the lower edge of the wall 30 on pan 20 and the annular flange 68 on enclosure 66 to prevent accidental separation of that enclosure from that pan.

The engagements between the springs 58 and the recesses 74 in the step-like surfaces 70 of enclosure 66 also will prevent any and all vibrations from accidentally causing that enclosure to rotate away from the position wherein those springs are in register with those recesses. Further, because those springs will coact with those recesses to alert the installer of the enclosure 66 to the fact that the enclosure has been rotated into the proper position, a heavy-handed installer will not rotate that enclosure so far in the clockwise direction that undue strains will be developed within that enclosure or that objectionably-high frictional forces will be developed between that enclosure and the pan 20.

To separate the enclosure 66 from the pan 20, it is only necessary to rotate that enclosure in the counterclockwise direction as it is viewed from below. When the notches 78 are in register with the flanges 50 of the strap 46, the enclosure 66 can be moved away from the pan 20.

The flanges 50 on the strap 46 are disposed below the level of the annular flange 26 on pan 20 a distance which is greater than the vertical distance between the annular flange 68 and the upper edge of the annular wall 76 on the enclosure 66. This enables the springs 58 on the flanges 50 to push the annular flange 68 up into engagement with the lower edge of skirt 30 while the upper edge of the wall 76 of the enclosure 66 remains below, and out of engagement with, the annular flange 26 on pan 20. This is important where the enclosure is made from glass; because the height of the wall 76 is a function of the severing operation that is performed after that enclosure has been "blown" in a mold. The severing operation can not be done with precision, and it can not leave a mold-smooth edge on that wall. Consequently, it is important to have the rotating engagement, between the pan 20 and the enclosure 66, displaced from the upper edge of the wall 76; and the present invention attains that result by causing the annular skirt 30 on pan 20 to engage the annular flange 68 on the enclosure 66. At such time, the flanges 50 will be below, but out of engagement with, the step-like surfaces 70. However, the springs 58 will span the distances between those flanges and those step-like surfaces.

In FIGS. 6 and 7, the numeral 82 generally denotes another preferred embodiment of ceiling canopy or mounting pan. That pan has a bottom 84, an annular wall 86, a horizontal annular flange 88, an annular rib 90 and an annular skirt 92 which preferably are identical to the bottom 22, wall 24, flange 26, rib 28, and skirt 30 of the pan 20. The pan 82 has a strap 94 secured to the bottom 84 thereof by rivets 100; and that strap has upwardly-bent arms 96 and outwardly extending flanges or ears 98. The flanges 98 can directly engage ramps 106 of an enclosure 102 to be used with the pan 82.

The enclosure 102 is similar to the enclosure 66, in that it has an annular collar-like wall 108, a horizontally-directed annular flange 107, and notches 110 which are essentially identical to the wall 76, the flange 68, and the notches 78 of the enclosure 66. However, the ramps 106 of enclosure 102 differ from the step-like surfaces 70 of the enclosure 66, in that the ramps 106 are inclined, and also do not have arcuate changes of surface intermediate the ends thereof.

The assembling of the enclosure 102 with, and the separating of that enclosure from, the pan 82 will be similar to the assembling of enclosure 66 with, and the separating of that enclosure from, the pan 20. However, the ramps 106 will be directly engaged by the edges of the flanges 98, as shown by FIG. 7, whereas the step-like surfaces 70 of enclosure 66 are spaced from the flanges 50 by the springs 58.

An installer of the enclosure 102 must use more care than is required of an installer of the enclosure 66. In the first place, the flanges or ears 98 are stiff and unyielding, whereas the springs 58 are flexible and are intended to yield. Further, the installer of the enclosure 102 must sense when an increase in the resistance of that enclosure to further rotation indicates that the enclosure has been properly assembled with the pan 82; whereas the springs 58 and the recesses 74 clearly indicate to an installer of enclosure 66 when that enclosure has reached the proper position. Additionally, and importantly, the springs 58 and recesses 74 establish a predetermined maximum force which the mold-smooth annular flange 68 can apply to the die-cut lower edge of the annular skirt 30; and that predetermined force is large enough to prevent accidental rotation of that enclosure but is small enough to prevent breaking or jamming of that enclosure.

FIGS. 1, 4 and 5 show a spring 58 with its foot 60 secured to one flange or ear 50 of the strap 46. If desired, the springs 58 could be replaced by stiff, inverted U-shaped bearing members that were held by guides in the flanges or ears 50 and that would be urged upwardly by helical springs. Those springs would hold the inverted U-shaped bearing members in raised position until they were forced downwardly by their engagement with the step-like surfaces 70 of the enclosure 66.

If manufacturing tolerances were to cause the arms 48 of strap 46 to be longer than intended, were to cause the annular skirt 30 to be longer than intended, and/or were to cause the thicknesses of the step-like surfaces 70 to displace the lower faces of those step-like surfaces downwardly below their normal levels, the upper portions of the springs 58 would still move into the recesses 74—those springs yielding a little more than usual, and thereby automatically compensating for any or all of those manufacturing tolerances. On the other hand, if manufacturing tolerances were to cause the arms 48 of strap 46 to be shorter than intended, were to cause the annular skirt 30 to be shorter than intended, and/or were to cause the thicknesses of step-like surfaces 70 to displace the lower faces of those step-like surfaces upwardly above their normal levels, the upper portions of the springs 58 would still move into the recesses 74—those springs yielding a little less than usual, and thereby automatically compensating for any or all of those manufacturing tolerances.

As shown by FIG. 7, the normal areas of engagement between the support-receiving surfaces of ramps 106 and of the support-providing surfaces of flanges or ears 98 are intermediate the ends of those support-receiving surfaces. This is very important; because it means that there are portions of those ramps which are ahead of, and behind, those normal areas of engagement which can assure full support for the enclosure 102 despite manufacturing tolerances in that enclosure, in the pan 82, and/or in the strap 94. For example, if manufacturing tolerances were to cause the arms 96 of the strap 94 to be longer than intended, were to cause the annular skirt 92 to be longer than intended, and/or were to cause the thicknesses of ramps 106 to displace the lower surfaces of those ramps downwardly below their normal levels, the upper or leading portions of those ramps would provide full support for the enclosure 102—thereby automatically compensating for any and all of those manufacturing tolerances. On the other hand, if manufacturing tolerances were to cause the arms 96 of the strap 94 to be shorter than intended, were to cause the annular skirt 92 to be shorter than intended, and/or were to cause the thicknesses of ramps 106 to displace the lower surfaces of those ramps above their normal levels, the lower or trailing portions of those ramps would provide full support for the enclosure 102—thereby automatically compensating for any and all of those manufacturing tolerances.

In each of the embodiments shown by the drawings, the collar-like annular wall on the enclosure will be shorter than the annular skirt on the pan. Consequently, regardless of manufacturing tolerances, the upper edge of that wall will always be below, and out of engagement with, the annular flange on the pan. Further, in each embodiment, the die-cut lower edge of the annular skirt of the pan will always engage the mold-smooth annular flange of the enclosure. As a result, the inevitably-rough upper edge of the annular collar-like wall of either enclosure can not bite into and jam against, or otherwise interfere with free rotation of that enclosure relative to, the mounting pan therefor.

Whenever the enclosure 66 is assembled with the pan 20, the engagements between springs 58 and recesses 74 will coact with the frictional force between annular skirt 30 and the annular flange 68 to prevent accidental separation of that enclosure from that pan. Similarly, when the enclosure 102 is assembled with the pan 82, the engagements between ramps 106 and the flanges or ears 98 will coact with the frictional force between annular skirt 92 and the annular flange 107 to prevent accidental separation of that enclosure from that pan. As a result, the enclosures 66 and 102 will remain in assembled relation with the mounting pans therefor as long as desired.

The flanges or ears 50, and the springs 58, are mounted well above the level of the broad central area 22 of the mounting pan 20. Similarly, the flanges or ears 98 are mounted well above the level of the broad central area 84 of the mounting pan 82. This is desirable, because it means that those flanges or ears and springs will not cast shadows on any normally-visible portions of the enclosures 66 or 102. However, if desired, the arms 48 of the strap 46, and the arms 96 of the strap 94, could be eliminated; and, in such event, the flanges 50 would lie in, or close to, the plane of the strap 46, and the flanges 98 would lie in, or close to, the plane of the strap 94. In such event, the skirts 30 and 90 would be made longer, or the walls 24 and 86 would be made shorter, to enable the lower edges of those skirts to engage the upper surfaces of the flanges 68 and 107, respectively.

In the preferred embodiments of the present invention, only two notches 78 are provided for the enclosure 66, only two notches 110 are provided for the enclosure 102, only two flanges or ears 50 are provided on the strap 46, and only two flanges or ears 98 are provided on the strap 94. Two flanges per strap and two notches per enclosure are completely adequate, and they are less expensive than three or more flanges per strap and notches per enclosure would be. However, if desired three or more flanges and notches could be provided; but multi-armed straps or a spider-like support would be needed to provide a matching number and spacing of enclosure-supporting flanges or ears.

The mounting pans and enclosures provided by the present invention obviate all need of a person standing on a chair, stool, ladder or the like for the considerable period of time which is needed to rotate knurled-head screws into or out of engagement with an enclosure to secure that enclosure to, or to free that enclosure from, a mounting pan. Also, those mounting pans and enclosures obviate the difficulty of rotating the small knurled-head screws which are commonly used to secure enclosures to mounting pans. In addition, those mounting pans and enclosures enable a person to use both hands to hold an enclosure instead of having to use only one hand to hold an enclosure and to use his or her other hand to try to rotate a small knurled-head screw into or out of engagement with that enclosure, to manipulate fingers or levers, or to insert or remove the legs of springs.

It should also be noted that the mounting pans and enclosures provided by the present invention automatically compensate for many manufacturing tolerances. Further those mounting pans and enclosures automatically provide and maintain continuous, dirt-excluding and insect-excluding face-to-face engagements between the die-cut lower edges of annular skirts 30 and 92 and the mold-smooth upper faces of annular flanges 68 and 107. Moreover, the step-like surfaces 70 and the springs 58 and the ramps 106 may positively limit rotation of the enclosures 66 and 102 to short angular extents—less than thirty (30) degrees. In these ways, the present invention assures ready installation and removal of the enclosures, provides automatic compensation for many manufacturing tolerances in those enclosures and in the mounting pans therefor, automatically keeps the flanges or ears 50 and 98 from casting shadows on normally-visible portions of those enclosures, automatically provides dirt-excluding and insect-excluding face-to-face engagements between the die-cut lower edges of annular skirts and the mold-smooth upper faces of annular flanges, and automatically limits the rotation of the enclosures, during the assembling thereof to the mounting pans, to limited angular extents.

The drawing and accompanying description have shown and described two preferred embodiments of the present invention, but it should be apparent to those skilled in the art that various changes may be made in the form of the invention without affecting the scope thereof.

What I claim is:

1. A lamp mounting which comprises a stationary support and an enclosure that are relatively rotatable into and out of engagement with each other, said enclosure having a plurality of circumferentially-spaced-apart, discontinuous, support-receiving surfaces thereon and also having a support-engaging surface thereon, said support having an enclosure-engaging surface thereon and also having a plurality of support-providing surfaces thereon, said support-providing surfaces responding to relative rotation of said support and of said enclosure to releasably engage and hold said support-receiving surfaces on said enclosure, and at least one of said support-providing surfaces on said support having means associated therewith for resiliently engaging one of said support-receiving surfaces on said enclosure as said enclosure and said support are, at least in part, moved relative to one another, said resilient mens responding to its engagement with said one support-receving surface on said enclosure to urge said enclosure to move axially and move said support-engaging surface on said enclosure into intimate, rotation-resisting engagement with said enclosure-engaging surface on said support, said resilient means thereafter continuing to urge said support-engaging surface on said enclosure axially into intimate, rotation-resisting engagement with said enclosure-engaging surface on said support until said support and said enclosure are rotated away from each other.

2. A lamp mounting as claimed in claim 1 wherein said enclosure has a downward-facing recess, wherein said resilient means comprises a resilient member having an arcuate upper surface that is engagable with said downward-facing recess, and wherein said resilient member will, whenever said enclosure is fully seated on and is held by said support, resiliently engage said downward-facing recess, to urge said support-engaging surface on said enclosure upwardly into close engagement with said enclosure-engaging surface on said support.

3. A lamp mounting as claimed in claim 1 wherein said resilient means comprises a member which can yield an appreciable distance axially of said enclosure to facilitate circumferential movement of said support-receiving surfaces on said enclosure relative to said resilient member in either direction.

4. A lamp mounting as claimed in claim 1 wherein said resilient means comprises an arcuate spring that has an upper surface which can move axially relative to said support-providing surfaces on said support, and wherein said resilient means helps cause said enclosure to move axially toward said support.

5. A lamp mounting as claimed in claim 1 wherein said resilient means is an arcuate spring that has two ends, one of said ends being secured to said one of said support-providing surfaces on said support but the other of said ends being free to move axially relative to said one support-providing surface to enable said arcuate spring to move said enclosure axially toward said support.

6. A lamp mounting as claimed in claim 1 wherein said resilient means is a cantilever-mounted spring which moves axially as it is engaged by said one of said support-receiving surfaces on said enclosure, said spring developing axially-directed restorative forces therein as it moves axially and responding to said axially-directed restorative forces to help move said support-engaging surface on said enclosure axially into engagement with enclosure-receiving surface on said support.

7. A lamp mounting as claimed in claim 1 wherein said resilient means is a cantilever-mounted spring that has an arcuate upper surface which can move axially relative to said one of said support-providing surfaces on said support and which can thereby facilitate circumferential movement of said support-receiving surfaces on said enclosure relative to said support, and wherein said resilient means thereafter urges said enclosure axially into engagement with said support.

8. A lamp mounting which comprises a stationary support and an enclosure that are relatively rotatable into and out of engagement with each other, said enclosure having a plurality of circumferentially-spaced-apart, discontinuous, support-receiving surfaces thereon, said support having a plurality of support-providing surfaces thereon which can respond to relative rotation of said support and of said enclosure to releasably engage and hold said support-receiving surfaces on said enclosure, at least one of said support-providing surfaces on said support including a member that has an upper surface and that resiliently, and at least in part moves as it engages and, resists relative movement of one of said support-receiving surfaces on said enclosure, said member responding to its engagement with said one support-receiving surface on said enclosure to urge said enclosure to move axially and move said support-engaging surface on said enclosure into intimate, rotation-resisting engagement with said enclosure-engaging surface on said support, said member thereafter continuing to urge said support-engaging surface on said enclosure axially into intimate, rotation-resisting engagement with said enclosure-engaging surface on said support until said support and said enclosure are rotated away from each other, and a further support-providing surface on said support which includes a second member that resiliently, and at least in part moves as it engages and, resists relative movement of, another of said support-receiving surfaces on said enclosure, each of said members having an outer surface that is smoothly arcuate and has a relatively-large radius and that lies in the path of one of said support-receiving surfaces on said enclosure, said smoothly-arcuate, large radii outer surfaces on said members facilitating said movement of said members when they engage said support-receiving surfaces.

9. A lamp mounting which comprises a stationary support and an enclosure that are relatively rotatable into and out of engagement with each other, said enclosure having a plurality of circumferentially-spaced-apart, discontinuous, support-receiving surfaces thereon, said support having a plurality of support-providing surfaces thereon which can respond to relative rotation of said support and of said enclosure to releasably engage and hold said support-receiving surfaces on said enclosure, at least one of said support-providing surfaces on said support including a portion that has an upper surface and that resiliently, and at least in part moves as it engages and, resists relative movement of one of said support-receiving surfaces on said enclosure, and one of said support-receiving surfaces on said enclosure including an upwardly-directed change of surface which can accommodate part of said upper surface of said portion of said one of said support-providing surfaces on said support.

10. A lamp mounting which comprises a stationary support and an enclosure that are relatively rotatable into and out of engagement with each other, said enclosure having a plurality of circumferentially-spaced-apart, discontinuous, support-receiving surfaces thereon, said support having a plurality of support-providing surfaces thereon which can respond to relative rotation of said support and of said enclosure to releasably engage and hold said support-receiving surfaces on said enclosure, at least one of said support-providing surfaces on said support including a portion that has an upper surface and that resiliently, and at least in part moves as it engages and, resists relative movement of one of said support-receiving surfaces on said enclosure, each of said support-receiving surfaces on said enclosure being step-like in form, and each of said step-like support-receiving surfaces including an upwardly-directed change of surface which can accomodate part of said upper surface of said portion of said one of said support-providing surfaces on said support.

11. A lamp mounting which comprises a stationary support and an enclosure that are relatively rotatable into and out of engagement with each other, said enclosure having a plurality of circumferentially-spaced-apart, discontinuous, support-receiving surfaces thereon, said support having a plurality of support-providing surfaces thereon which can respond to relative rotation of said support and of said enclosure to releasably engage and hold said support-receiving surfaces on said enclosure, at least one of said support-providing surfaces on said support including a portion that has an upper surface and that resiliently, and at least in part moves as it engages and, resists relative movement of one of said support-receiving surfaces on said enclosure, each of said support-receiving surfaces on said enclosure being generally planar, and each of said generally-planar support-receiving surfaces including an arcuate upwardly-directed change of surface which can accomodate part of said upper surface of said of said one of said support-providing surfaces on said support.

12. A lamp mounting which comprises a stationary support and an enclosure that are relatively rotatable into and out of engagement with each other, said enclosure having a plurality of circumferentially-spaced-apart, discontinuous, support-receiving surfaces thereon and also having a support-engaging surface thereon, said support having an enclosure-engaging surface thereon and also having a plurality of support-providing surfaces thereon, said support-providing surfaces responding to relative rotation of said support and of said enclosure to releasably engage and hold said support-receiving surfaces on said enclosure, and at least one of said support-providing surfaces on said support including a member that resiliently, and at least in part moves as it engages and, resists relative movement of one of said support-receiving surfaces on said enclosure, said member responding to its engagement with said one support-receiving surface on said enclosure to urge said enclosure to move axially and move said support-engaging surface on said enclosure into intimate, rotation-resisting engagement with said enclosure-engaging surface on said support, said member thereafter continuing to urge said support-engaging surface on said enclosure axially into intimate, rotation-resisting engagement with said enclosure-engaging surface on said support until said support and said enclosure are rotated away from each other, said resilient member is an arcuate spring which has a relatively-large radius of curvature to enable it to serve as an arcuate, inclined plane and thereby help move said enclosure axially toward said support.

13. A lamp mounting which comprises a stationary support and an enclosure that is releasably securable to said support, said enclosure having a plurality of circumferentially-spaced support-receiving surfaces thereon and also having a support-engaging surface thereon which is displaced both axially and radially from said support-receiving surfaces, said support having a plurality of support-providing surfaces thereon which can releasably engage and hold said support-receiving surfaces on said enclosure and also having an enclosure-engaging surface thereon which is displaced both axially and radially from said support-receiving surfaces and which can releasably engage said support-engaging surface on said support, said support-receiving surfaces on said enclosure and said support-providing surfaces on said support being oriented so relative rotation of said enclosure and said support in one direction places said support-receiving surfaces on said enclosure in holding engagement with said support-providing surfaces on said support and forces said support-engaging surface on said enclosure to move axially into intimate, rotation-stopping engagement with said enclosure-engaging surface on said support, whereby said support-receiving surfaces on said enclosure and said support-providing surfaces on said support constitute interacting, axial-motion-enforcing and rotation-stopping surfaces, said enclosure and said support being relatively rotatable in the opposite direction to move said support-receiving surfaces on said enclosure out of holding engagement with said support-providing surfaces on said support and to free said support-engaging surface on said enclosure for axial movement away from said enclosure-engaging surface on said support, said support-receiving surfaces on said enclosure and said support-providing surfaces on said support coacting to respond to relative movement of said support and of said enclosure in said one direction, at points intermediate the ends of all of said interacting, axial-motion-enforcing surfaces, to force said support-engaging surface on said enclosure into said intimate, rotation-stopping engagement with said enclosure-engaging surface on said support and thereby provide a positive limit on rotatiion of said enclosure relative to said support in said one direction.

14. A lamp mounting as claimed in claim 13 wherein said support-receiving surfaces on said enclosure and said support-providing surfaces on said support provide said positive limit on said rotation of said enclosure relative to said support in said one direction to limit said rotation to less than thirty degrees.

15. A lamp mounting which comprises a stationary support and an enclosure that are relatively rotatable into and out of engagement with each other, said enclosure having a plurality of circumferentially-spaced support-receiving surfaces thereon and also having a support-engaging surface thereon which is displaced radially from said support-receiving surfaces, said support having a plurality of support-providing surfaces thereon and also having an enclosure-engaging surface thereon which is displaced radially of said support-providing surfaces and which can releasably engage said support-engaging surface on said enclosure, said support-receiving surfaces on said enclosure and said support-providing surfaces on said support responding to relative rotation of said support and of said enclosure in one direction to releasably engage and hold each other and to force said support-engaging surface on said enclosure to move axially into intimate, rotation-stopping engagement with said enclosure-engaging surface on said support, said support-receiving surfaces on said enclosure being intercepted by portions of said support-providing surfaces on said support which are intermediate the ends of said support-providing surfaces on said support and causing said support-engaging surface on said enclosure to move axially into intimate, rotation-stopping engagement with said enclosure-engaging surface and thereby be held against further relative rotation in said one direction, whereby said support-receiving surfaces on said enclosure cannot respond to relative rotation in said one direction to pass beyond said support-providing surfaces on said support.

16. A lamp mounting as claimed in claim 15 wherein said support-receiving surfaces on said enclosure are step-like in form and have arcuate recesses intermediate the ends thereof.

* * * * *